US006705238B1

(12) United States Patent
Heckert

(10) Patent No.: US 6,705,238 B1
(45) Date of Patent: Mar. 16, 2004

(54) SCISSORS-TYPE LIFTING TABLE

(75) Inventor: Gerold Heckert, Sachsenheim (DE)

(73) Assignee: Heckert GmbH (DE)

( * ) Notice: Subject to any disclaimer, the term of this patent is extended or adjusted under 35 U.S.C. 154(b) by 53 days.

(21) Appl. No.: 10/018,102

(22) PCT Filed: Mar. 25, 2001

(86) PCT No.: PCT/EP00/02657

§ 371 (c)(1),
(2), (4) Date: Nov. 5, 2001

(87) PCT Pub. No.: WO00/68596

PCT Pub. Date: Nov. 16, 2000

(30) Foreign Application Priority Data

May 8, 1999 (DE) ..... 199 21 435

(51) Int. Cl.[7] ..... A47B 9/00
(52) U.S. Cl. ..... 108/145; 248/421
(58) Field of Search ..... 108/145, 147; 254/122; 248/421, 588, 575, 157, 277.1

(56) References Cited

U.S. PATENT DOCUMENTS

| | | | | |
|---|---|---|---|---|
| 3,785,462 A | | 1/1974 | Coad et al. | |
| RE27,914 E | * | 2/1974 | King | 182/16 |
| 4,585,212 A | | 4/1986 | Yanker | |
| 4,638,610 A | * | 1/1987 | Heikkinen | 52/109 |
| 4,682,750 A | * | 7/1987 | Rudolph et al. | 108/145 |
| 4,926,760 A | * | 5/1990 | Sack | 108/145 |
| 5,339,749 A | * | 8/1994 | Hirose | 108/143 |
| 5,476,050 A | * | 12/1995 | Zimmer et al. | 108/145 |
| 5,588,377 A | * | 12/1996 | Fahmian | 108/145 |
| 5,632,209 A | * | 5/1997 | Sakakibara | 108/145 |
| 5,694,864 A | * | 12/1997 | Langewellpott | 108/145 |

FOREIGN PATENT DOCUMENTS

| | | | |
|---|---|---|---|
| DE | 26 35 197 A 1 | | 2/1978 |
| DE | 33 31 872 A 1 | | 4/1984 |
| DE | 3608231 | * | 9/1987 |
| DE | G 90 05 566.7 | | 8/1990 |
| DE | 34 34 130 C 2 | | 1/1993 |
| DE | 43 36 833 A 1 | | 6/1994 |
| DE | 44 13 527 A 1 | | 10/1995 |
| DE | 197 44 519 C 1 | | 12/1998 |
| EP | 0 032 119 | | 1/1981 |
| EP | 44 715 B | | 1/1990 |
| FR | 1.026.383 | | 4/1953 |

* cited by examiner

*Primary Examiner*—Jose V. Chen
(74) *Attorney, Agent, or Firm*—Jansson, Shupe & Munger, Ltd.

(57) ABSTRACT

The disclosure relates to a scissors lifting device having a pair of scissors positioned between a carrier unit and a base unit. The scissors have inner arms and outer arms which can pivot in relation to each other about a scissors axle. The lifting device further includes a lifting truck that can be moved back and forth by means of a drive in order to open and close the scissors. According to the invention, a drive shaft that is oriented parallel to the scissors axle is coupled to the drive and enables at least one traction mechanism that is arranged around the drive shaft and is coupled to the lifting truck to be moved in both directions of rotation. This results in a construction having a reliable drive.

14 Claims, 1 Drawing Sheet

SCISSORS-TYPE LIFTING TABLE

RELATED APPLICATION AND CLAIM OF PRIORITY

This application is a continuation of PCT Application No. PCT/EPO/02657 having an international filing date of Mar. 25, 2000, which designates at least one country in addition to the United States and which claims priority from German Application No. 199 21 435.2 filed Mar. 13, 1996. For priority purposes, this application claims the benefit of 35 USC 371 and/or 35 USC 120.

FIELD OF INVENTION

The invention pertains to a scissors lifting table device having a pair of scissors positioned between a carrier unit and a base unit. The scissors have an inner arm and an outer arm pivotably connected to one another at a scissors axle. The lifting device further includes a lifting truck movable back and forth by means of a drive for opening and closing the scissors, a drive shaft coupled to the drive and movable in both rotational directions, and at least one traction means looped around the drive shaft and coupled to the lifting truck.

A lifting table device of this type, typically used for raising and lowering loads, e.g., in automobile production, is described in U.S. Pat. No. 3,785,462, which discloses a scissors lifting table which uses a cable with one end anchored to the carrier unit and the other end fixed to a lower cam shaft. The cable is looped around several rollers, as well as a roller-like lifting element that is positioned between the inner and outer arms and movable towards the scissors axle. By winding and unwinding the cable on the lower cam shaft by means of a shaft powered by a chain, the lifting element is moved relative to the scissors axle, so that the carrier unit is raised or lowered.

Another scissors lifting table is described in DE 90 05 566 U1. In this scissors lifting table, two pairs of scissors are arranged parallel to one another at opposite sides of a carrier device having a platform and a frame-like base unit, and are provided for raising and lowering the platform by opening and closing. Opening and closing the scissors is accomplished by the back and forth movement along the base unit of a lifting slide or truck with laterally located oblique lifting curves on its upper side which contact rollers located near the scissors axle. The movement of the lifting slide is effected by a threaded spindle positioned perpendicular to the scissors axle. Such a spindle is a precision part and is typically bearing-mounted in a spindle nut. Such a spindle drive is not only costly but is also sensitive to transverse forces and vibrations which can disturb operation or damage the spindle drive.

In the scissors lifting table disclosed by DE 44 13 527 A1, an actuating drive with essentially horizontal rollers is located at the level of the rotational axis of the scissors. The rollers work in combination with control curves situated on the scissors arms, while the shafts of the rollers are parallelly displaced in the medial plane by an actuating drive. A hydraulic reciprocating piston actuator acts as the actuating drive. Such a hydraulic actuator typically involves jerky starting and stopping of the lifting movement and can also cause oily deposits and is therefore undesirable.

Additional scissors lifting tables are described in DE 83 29 409 U1 and DE 197 44 519 C1.

Disclosed in DE 33 31 872 A is a roller-like lifting device which has a piston-cylinder unit connected to a chain which is fastened to a roller. The roller is positioned near the pivot of the scissors arms and is pulled toward the pivot by movement of the piston so as to raise and lower the upper part.

SUMMARY OF THE INVENTION

Fundamental to the invention is the objective of providing a scissors lifting table device of the type cited in the introduction, in which the lifting movement can be controllably and reliably performed without the risk of dirt accumulation.

The objective is realized by the inventive scissors lifting device which utilizes at least one band-like toothed belt. The drive shaft has on its circumference, at least in some areas, a toothing which works in combination with the toothing of the one or more toothed belts.

Using this configuration of the drive mechanism of the lifting truck allows for controlled and reliable movement of the lifting truck without risk of disruption and avoids the undesirable accumulation of dirt, while being cost-effective. In a preferred embodiment several, e.g., four, toothed belts are used in parallel, which is readily possible with the drive shaft. Thus, when a belt is damaged the lifting operation can be safely continued until a suitable repair opportunity is available.

In a preferred embodiment, the drive shaft is rigidly mounted on the base unit and at least one reversal element is provided. The reversal elements being rotatably mounted on a rotational shaft at a fixed distance from and parallel to the drive shaft. The reversal elements redirect the belt during use.

In preferred operation the reliability of the drive mechanism is ensured by the use of several, e.g., three or four, toothed belts as well as a corresponding number of reversal elements.

The toothed belt(s) preferably forms an upper part and a lower part and the lifting truck is preferably coupled to the upper part so that movement of the lifting truck is facilitated.

The preferred toothed belt has two ends, both of which are fastened to the lifting truck, while a tensioning device for tightening the respective toothed belt is preferably interconnected between at least one of the ends and the truck. Alternatively, tensioning of the toothed belt could be accomplished by adjusting the respective reversal elements.

For the installation and maintenance of the scissors lifting table, it is preferable that the drive have a transmission section with a tubular shaft stub, into which a matching end section of the drive shaft is inserted.

To further simplify maintenance the drive is preferably mounted laterally outside the base unit and fixed to the base unit. The drive is preferably equipped with a brake and a torque support.

In a preferred design two parallel inner arms are mounted on inner surfaces of the carrier unit and two parallel outer arms are mounted on the outer side of the carrier unit and the lifting truck rests on the inner arms so as to roll or glide, while an interchangeable lifting curve or cam that determines the lifting movement is provided on at least one outer arm for opening and closing the scissors to effect the lifting movement.

It is preferred that the drive shaft be located near a base-side pivoting axis of the inner arms and the rotational shaft of the reversal elements be located near the inner arms on the side of the scissors axle opposite the drive shaft, then the lifting truck is safely guided in the inner arms to complete the lifting movement all the way to the open and closed positions.

It is also preferred that the lifting truck have two pairs of rollers, staggered in the running direction and supported on the inner arms, and a pair of lifting rollers for working in combination with the lifting curves or cams.

An alternative design of the scissors lifting table device comprises a lifting truck glidingly mounted on the base unit and bearing on both sides a pair of lifting curves, oriented in the movement direction, which work in combination with a pair of lifting rollers riding thereon that are rigidly mounted on two opposing parallel arms of the scissors or the scissors axle.

The invention is explained in greater detail below with reference to an embodiment example illustrated in the appended drawings.

DETAILED DESCRIPTION OF PREFERRED EMBODIMENTS

Figure 1:
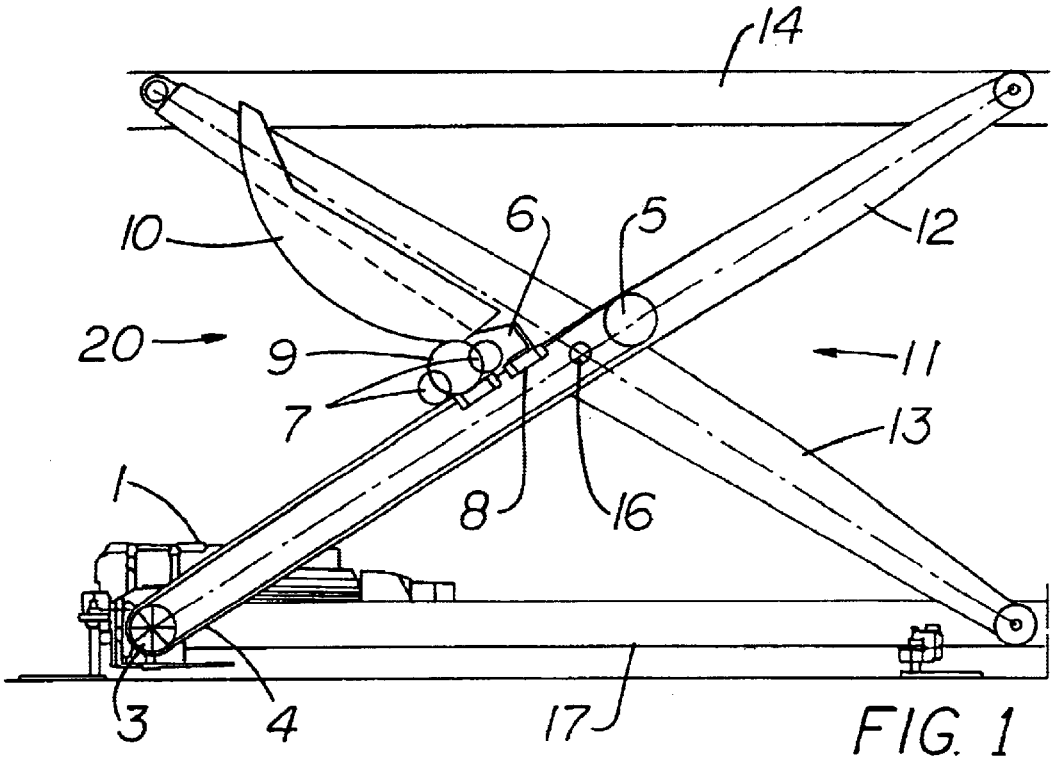
FIG. 1 shows a partial cutaway side view of a scissors lifting table device from the inside and FIG. 2 shows a partial cutaway view of the scissors lifting table device from the top.

A scissors lifting table device 20 is shown in FIG. 1 in a partial cutaway side view from the inside, in which a scissors structure 11 having two inner legs 12 and two outer legs 13, interconnected at a scissors axle 16 is arranged between a frame-like base unit 17 that can be anchored to the floor and a carrier unit 14, such as a platform, used to support an auto body.

Figure 2:
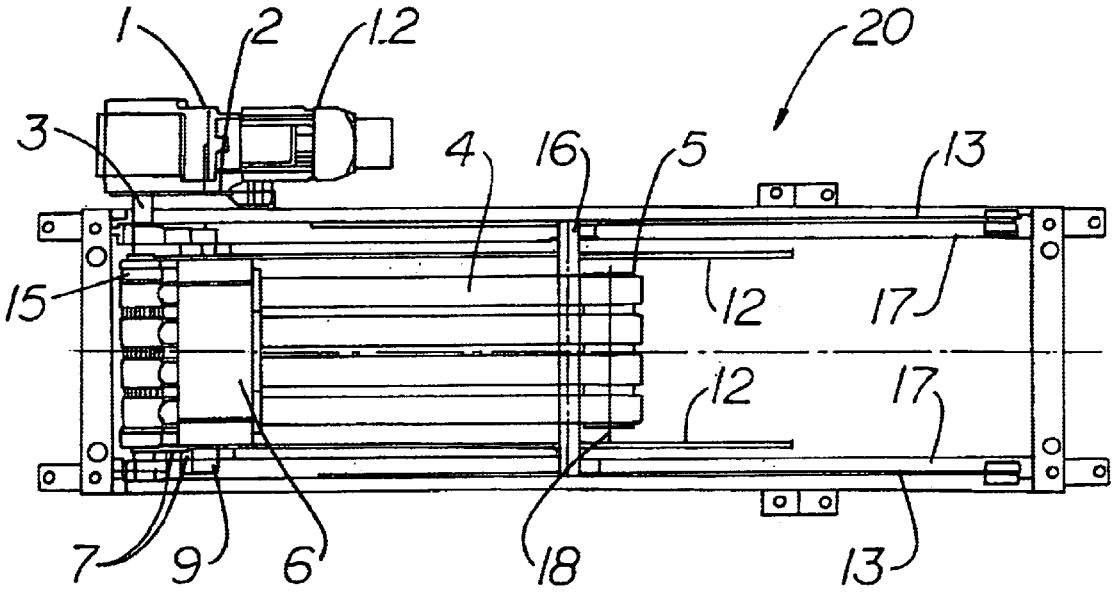

As is apparent in FIG. 2, two such scissors structures 11, with parallel inner legs 12 and parallel outer legs 13, are mounted to pivot at the same end of both sides of the base unit 17 and carrier device 14 (at the left end in FIGS. 1 and 2), and are seated movably at the other leg end (at the right end in FIGS. 1 and 2). A drive 1 in the form of an electric motor is arranged laterally on the outside of base unit 17, and is coupled to a brake 1.2 and mounted secure from rotation with a torque support arm 2. A drive shaft 3, provided in some areas with toothing on its outside circumference, is inserted into drive 1 or a transmission section of it. The drive shaft 3 is mounted to rotate in rotation bearings 15 in the vicinity of the lower pivot axis of inner leg 12 of scissors structure 11 on the longitudinal struts or transverse struts or separate support elements of base unit 17.

FIG. 2 depicts four toothed belts 4 at a slight spacing from each other having toothings that match the toothing of the drive shaft 3 being positioned around drive shaft 3, and guided around corresponding reversal elements 5 which are toothed belt wheels that are mounted on the rotation shaft 18 which is positioned at the end of inner legs 12 opposite drive shaft 3 and beyond scissors axle 16. The drive shaft 3, the scissors axle 16 and the rotation shaft 18 of the reversal elements 5 are parallel to each other. The toothed belt wheels 5 each have lateral flanges so that the toothed belts 4, forming a tight side and a slack side, are guided reliably. The toothed belt wheels 5 can be formed on a common shaft or axis and, if desired, also provided with toothing.

A lifting truck 6, which is fastened at clamping sites 8 to the four toothed belts 4 by clamping means, is arranged on the top tight side of the toothed belts 4. Rotatably adjustable tensioning devices 8 are provided on at least one of each belt's clamping sites 8 for tightening the corresponding toothed belts 4. The toothed belts 4 are fastened with both of their ends to the clamping sites 8. The lifting truck 6 is supported with support rollers 7 which ride either on the upper edge of the inner leg 12 or on rails which are preferably replaceable and can be mounted laterally on the inner legs 12. Support rollers 7 comprise two pairs of laterally opposite support rollers that are spaced from each other in the direction of travel. The lifting truck 6 also has a pair of laterally opposite lifting rollers 9 that roll beneath lifting cams 10 which are positioned on the two outer legs 13 at their upper leg section relative to the scissors axle 16 during a movement of the lifting truck 6. The lifting cam 10 can be shaped according to a desired timing of the lifting movement so that, for example, the lifting movement begins slowly, is accelerated and then stops slowly. The lifting cam 10 can also be formed on its ends so that, toward the end of movement of the lifting truck 6, no further lifting movement is produced thereby allowing an exact final height of the carrier device 14 to be reached.

To execute the lifting movement, the lifting truck 6, with drive 1, is moved in the desired direction into the desired position by a drive shaft 3 and toothed belts 4. Position adjustment can be monitored or controlled by means of position detectors. An unintentional downward movement is reliably avoided with brake 1.2. Should a toothed belt 4 break, the lifting operation can be temporarily continued with the other toothed belts 4 until an appropriate opportunity to replace the damaged toothed belt 4 presents itself.

What is claimed is:

1. A scissors lifting device having a base unit, a carrier unit and at least one pair of scissors having inner and outer legs pivotably mounted at a scissors axle and connected to the base unit and carrier unit, the lifting device comprising:

a drive for opening and closing the scissors;

a drive shaft parallel to scissors axle and coupled to the drive for rotational movement in both directions, and having a toothing on its circumference;

at least one band-like toothed belt looped around the drive shaft and engaging the toothing; and a lifting truck coupled to each belt.

2. The lifting device of claim 1 wherein the drive shaft is rigidly mounted on the base unit and further comprising a rotation shaft positioned at a fixed distance from and parallel to the drive shaft, and at least one reversal element rotatably mounted on the rotation shaft, each reversal element engaging and redirecting a respective belt.

3. The lifting device of claim 2 comprising two belts and two corresponding reversal elements.

4. The lifting device of claim 2 wherein each inner leg pivotably connects to the base at a base axis, the drive shaft is located near the base axis, and the rotation shaft is positioned so that the scissors axle is between the rotation shaft and the base axis.

5. The lifting device of claim 2 wherein the lifting truck has two rollers staggered in the direction of truck movement and riding on at least one of the inner legs, and a lifting roller for engaging a lifting cam.

6. The lifting device according to claim 1 wherein each belt forms an upper part and a lower part and the lifting truck is coupled to the upper part of each belt.

7. The lifting device of claim 6 wherein each belt has two ends, each end being fastened to the lifting truck, and further comprising at least one tensioning device connected at one of the ends of each belt.

8. The lifting device of claim 1 wherein the base unit has an outer side and the drive is mounted to the outer side and is equipped with a brake for stopping rotational movement of the drive shaft.

9. The lifting device of claim 8 wherein the base unit is equipped with a torque support arm.

10. The lifting device of claim 1 wherein the base unit and carrier unit have inner and outer sides, each inner leg is connected to the inner sides of the base unit and carrier unit and each outer leg is connected to the outer sides of the base unit and carrier unit, and the lifting truck rides on at least one of the inner legs, further comprising at least one lifting cam positioned on at least one of the outer legs so that the lifting truck and each lifting cam operate in conjunction to open and close the scissors.

11. A scissors lifting device comprising:

a base unit;

a carrier unit;

an inner leg having first and second ends, the first end pivotably mounted to the base unit at an inner pivot, the second end slidingly engaging the carrier unit;

an outer leg having first and second ends, the first end slidingly engaging the base unit, the second end pivotably mounted to the carrier unit at an outer pivot, the outer leg pivotably mounted to the inner leg at a scissors axle;

a drive for raising the carrier unit;

a drive shaft parallel to scissors axle and coupled to the drive to provide rotational movement in both directions, the drive shaft having a toothing on its circumference and being positioned near the inner pivot;

a rotation shaft parallel to the drive shaft and positioned at a fixed distance from the drive shaft along the inner leg;

a band-like toothed belt looped around the drive shaft and rotation shaft and engaging the toothing; and a lifting truck coupled to the belt and movable along the inner leg between the drive shaft and the scissors pivot, the lifting truck providing contact with respect to the outer leg so that movement of the truck toward the scissors pivot causes the inner and outer legs to open.

12. The lifting device of claim 11 further comprising a reversal element rotatably mounted on the rotation shaft, the reversal element engaging and redirecting the belt.

13. The lifting device of claim 11 wherein the belt has two ends, each end being fastened to the lifting truck, and further comprising a tensioning device connected at one of the ends.

14. A scissors lifting device including a base unit, a carrier unit, first and second scissor-like legs connected at a scissors pivot and pivotably and slideably connected relative to the base unit and carrier unit, the lifting device comprising:

a drive for raising the carrier unit;

a drive shaft parallel to scissors axle and coupled to the drive to provide rotational movement in both directions, the drive shaft having a toothing on its circumference and being positioned near a pivotable connection between the first leg and the base unit;

a rotation shaft parallel to the drive shaft and positioned at a fixed distance from the drive shaft along the first leg;

a band-like toothed belt looped around the drive shaft and rotation shaft and engaging the toothing; and a lifting truck coupled to the belt and movable between the drive shaft and the scissors pivot, the lifting truck providing contact with respect to the second leg so that movement of the truck toward the scissors pivot causes the legs to open.

* * * * *